US005433881A

United States Patent [19]

Townend et al.

[11] Patent Number: 5,433,881

[45] Date of Patent: * Jul. 18, 1995

[54] GRANULATION PROCESS FOR MAKING GRANULAR BLEACH ACTIVATOR COMPOSITIONS AND RESULTING PRODUCT

[75] Inventors: John Townend; Anthony J. Gradwell; John D. Withenshaw, all of Clwyd, Wales

[73] Assignee: Warwick International Group Limited, Leeds, England

[ * ] Notice: The portion of the term of this patent subsequent to May 1, 2007 has been disclaimed.

[21] Appl. No.: 984,533

[22] Filed: Dec. 2, 1992

Related U.S. Application Data

[63] Continuation-in-part of Ser. No. 629,072, Dec. 17, 1990, abandoned, which is a continuation of Ser. No. 442,492, Nov. 27, 1989, abandoned, which is a continuation of Ser. No. 27,636, Mar. 19, 1987, abandoned.

[30] Foreign Application Priority Data

Mar. 19, 1986 [GB] United Kingdom ..... 8606804

[51] Int. Cl.[6] ..... C11D 3/36; C11D 3/37; C11D 3/395; C11D 17/06

[52] U.S. Cl. ..... 252/95; 252/99; 252/102; 252/174.13; 252/174.18; 252/174.24; 252/182.12; 252/182.29; 252/186.27; 252/186.3; 252/186.38; 252/526; 252/524; 252/542; 252/545; 252/DIG. 11

[58] Field of Search ..... 252/99, 102, 174.13, 252/174.18, 174.24, 186.2, 186.25, 186.38, 95, 524, 542, 182.12, 182.29, 186.27

[56] References Cited

U.S. PATENT DOCUMENTS

| | | | |
|---|---|---|---|
| 3,151,084 | 9/1964 | Schlitz | 252/526 |
| 4,372,868 | 2/1983 | Saran | 252/102 |
| 4,726,908 | 2/1988 | Kruse | 252/91 |

FOREIGN PATENT DOCUMENTS

| | | | |
|---|---|---|---|
| 2234980 | 2/1991 | United Kingdom | 252/174.24 |

*Primary Examiner*—Dennis Albrecht

*Attorney, Agent, or Firm*—Ostrolenk, Faber, Gerb & Soffen

[57] ABSTRACT

An improvement in the process of granulating bleach activator using an organic binder selected from starch and cellulose derivatives polyacrylates, polymaleates and polyvinyl pyrrolidone, the process comprising dry mixing particulate activator and at least a portion of the binder in particulate form and then moistening the mixture with a granulating liquid, comprises using as granulating liquid an aqueous solution of a granulating aid which is a sequestrant optionally combined with a water-soluble inorganic salt. The granules are then dried. The product has improved activity in laundry detergents especially in low temperature wash and cold fill conditions.

23 Claims, No Drawings

GRANULATION PROCESS FOR MAKING GRANULAR BLEACH ACTIVATOR COMPOSITIONS AND RESULTING PRODUCT

This application is a continuation-in-part of application Ser. No. 07/629,072, filed Dec. 17, 1990, which in turn was a continuation of Ser. No. 07/442,492 filed Nov. 27, 1989 and which in turn was a continuation of application Ser. No. 07/027,636, filed Mar. 19, 1987 all of which are now abandoned.

The present invention relates to granular detergent activator compositions with improved low temperature activity, granular detergent compositions containing them and a process suitable for producing them.

It is well known to incorporate into detergent compositions bleaching compounds such as perborates and other peroxy bleaches and to activate the bleaches in situ using activators for these bleach compounds. The activators must be prevented from coming into contact with the bleach so as to reduce or eliminate reaction of the activator with the bleach compound prior to dissolution of the entire detergent composition in water. This may be done by providing the bleach and bleach activator in separate compositions or by forming the activator into dry granules with binder, the granules being one component in the dry particulate detergent composition.

One example of the former method is described in EP-A-0170791 in which the bleach activator is compressed into a tablet with other ingredients, including an alkane polyphosphonic acid, a binder and, optionally, a conventional tablet disintegration aid, i.e. a water-insoluble, water-swellable compound. Even with such disintegration aids the tablets disintegrate too slowly and are not satisfactorily dispersed throughout the water to which they are added. It is inconvenient from the point of view of manufacture since the tableting process is multi-stage and from the point of view of packaging the detergent compositions and for the consumer to have separate compositions.

It is preferred to provide the activator in the form of granules. Upon dissolution in water the granules are intended to release the activator so as to activate the bleach compound. It is generally intended that this should occur at relatively low wash temperatures (typically 50° C.) and so the amount of activator, and its method of granulation, must be such that the desired activity is achieved at the chosen temperature.

The detergent powdered composition will contain a large number of components in addition to the surfactant and bleach components. For instance typical compositions may contain cellulose derivatives, sequestering agents such as ethylene diamine tetra acetic acid or salts thereof or phosphonic acid sequestering agents, sodium sulphate, sodium silicate, and phosphates or polyphosphates.

It is already known to use some of these materials to form the granules of the activator. There are several methods currently used for granulating the activator.

In one method,, such as the method that is said to be preferred in GB-A-2,O53,998, particulate activator is granulated using triphosphate. For instance a saturated aqueous solution of potassium triphosphate may be sprayed on to a blend of particulate activator and particulate sodium triphosphate. Unfortunately this makes it inevitable that the detergent composition contains large amounts of phosphate and this may be undesirable for environmental reasons.

In a second method, the activator is granulated using a melt of detergent components usually nonionic surfactant, for instance as described in GB-A-1,557,768, GB-A-1561333, EP-A-0062523, EP-A-0106634 and US-4726908. The resultant granules can then only be used in detergent compositions with which the granulating detergent is compatible, and this therefore restricts the potential use of the granulated activator composition. Furthermore the amount of the meltable binder which needs to be used for adequate particle integrity are stabilising of the activator is high, for instance above 20% of the weight of the final granule or other particle. Furthermore in order to prevent stickiness of the particles especially where storage may be at temperatures higher than room temperature it is necessary to add absorbent for instance silica or talc (as described in U.S. Pat. No. 4,726,908). Both of these factors mean that the proportion of activator in the granule or other particle is necessarily reduced so that the activity of the particulate product on a weight basis is reduced. The need to add an absorbent material such as in U.S. Pat. No. 4,726,908 involves an extra processing step. The intermediate product of the first step may be difficult to handle as it will be sticky because of the large amount of binder dissolution in the wash liquor may be slow.

In a third method, the particulate activator is granulated by compaction of a wet mix of the binder and the activator, e.g. by extrusion through a die or between rollers followed by chopping to the desired size as in EP-A-0075818.

That specification suggests using a water-insoluble but water swellable disintegration aid, but such materials do not lead to satisfactory disintegration of the granules or do not do so quickly enough at low temperatures, especially when quite high amounts of binder are used.

In DE-A-2048331 (and U.S. Pat. No. 3,789,002) bleach activator granules are produced by mixing dry particles of the activator with inorganic salts containing water of hydration and then moistening the blend with water or a solution of organic binder, which is selected from inorganic salts, organic binders and detergent compounds. The binder is present in the final gruanules in an amount in the range 1–20% by weight but usually less than 10%. The problem with using an aqueous solution or dispersion of organic binder is that such aqueous mixtures are viscous and difficult to handle especially at high concentrations. This limits the amount of the binder that can practically be incorporated into the granules since the addition of large amounts of water renders the blend a pasty mixture which cannot be handled, or the liquid must be added over an extended period, which is undesirable, and the process becomes uneconomic because of the large energy requirements for drying the granules. The low amounts of organic binder that can be used may be insufficient for satisfactory strength properties.

An improvement of the process in DE-A-2048331 using aqueous solutions of organic binders of the type including starch and cellulose derivatives is described in EP-A-0037026 (U.S. Pat. No. 4,372,868) where, instead of incorporating all of the organic binder in solution or dispersion in the water used to moisten the dry bleach activator, part or all of the binder is mixed as dry particles with the activator particles, before the moistening takes place. Again, water-swellable materials can be incorporated into the granules as disintegration aids, but these do not give satisfactory increases in the rate of disintegration of the granules in use, especially at low temperatures.

In DE-A-3247893 special polyphosphonic acids and their water soluble salts are used as stabilisers for bleach activators. It is stated that the stabilisers can be co-granulated with the bleach activator by mixing dry stabiliser with dry activator particles and then granulating by any of the conventional processes e.g. by spraying a dry blend with a solution of an organic binder. This process suffers the same disadvantage as DE-A-2048331 described above. There is no suggestion in that specification that the inclusion of particulate polyphosphonate as part of the dry ingredients affects the rate of disintegration of the granules and thus the rate of dissolution of activator in the wash liquor. In fact the present inventors have discovered that the inclusion of particulate polyphosphonate does not significantly affect the rate of dissolution of bleach activator as determined by the rate of activation of a peroxygen bleach source.

The method of granulation of bleach activator described in EP-A-0037026 and DE-A-2048331 has the advantages that it does not cause environmental pollution and the granulate can be used in a wide variety of detergent compositions. However it has the disadvantage that the amount of binder has to be low. The level of organic binder used in the examples is always less than 6% by weight of solid components of the granule. These low levels of binder can result in the granules breaking during manufacture, causing processing difficulties. The product has, despite this, been widely accepted as being very successful.

However the present inventors have now observed that despite the success of the product it does not achieve its full potential during use at low temperatures. In particular it is believed that during a normal low temperature wash cycle a significant amount of the activator is not released into solution early enough or at all. This problem becomes particularly serious with decreasing wash temperature and when the composition is used in cold fill machines where the water temperature can be less than 20° C.

The object of the present invention is to provide an improved process of the type using starch or cellulose derivatives or synthetic water-soluble polymers for producing a granulated bleach activator composition that gives improved activity, especially at low wash temperatures and with cold-fill wash cycles. It would also be desirable to be able to increase the amount of binder used in the process above the levels proposed in EP-A-0037026 without causing the composition to have inadequate activity.

In the invention there is provided a new process wherein 100 parts by weight of a particulate mixture consisting essentially only of:

i) 98 to 38 parts by weight of bleach activator particles ii) 2 to 70 parts by weight of water-soluble or water swellable organic binder selected from the group consisting of starch and its derivatives, cellulose and its derivatives, polyacrylates, polymaleates and polyvinyl pyrrolidones; and iii) up to 10 parts by weight other particulate components, is dry mixed and moistened during mixing by an aqueous granulating liquid which consists essentially only of iv) 1 to 20 parts by weight of dissolved granule disintegration aid, which is selected from the group consisting of sequestering agents and mixtures of sequestering agents and water soluble inorganic salt, v) 0 to 70 parts by weight water soluble or water swellable organic binder selected from the group consisting of starch and its derivatives, cellulose and its derivatives, polyacrylates, polymaleates and polyvinyl pyrrolidone provided that the total amount of organic binder used in the process is no more than 70 parts by weight, vi) up to 10 parts by weight other water-dispersible components, provided that the total amount of said other particulate component and said other water-dispersible component is no more than 10 parts by weight, vii) water to form moist granules and the moist granules are then dried to form any product granules.

In the present specification the "standard composition" is one particular example of a typical composition made by the process described in EP-A-0037026. It is formed by mixing dry particles of tetraacetylethylenediamine (TAED) bleach activator (100 parts) with dry particles of sodium carboxymethylcellulose (CMC) binder (5.53 parts) in a suitable mixer (e.g. a Schugi Flexomix (trade mark) or a Loedige ploughshare mixer) for 3 minutes and then adding about 23 parts water. Mixing is continued for a further 2 minutes after which the product is discharged and dried for 15 minutes at 60° C. using a fluid bed drier.

The presence of the disintegration aid causes substantial increase in the activity of the product granules when dissolved in water at 20° C. containing perborate and a detergent base in a simulation of a cold-fill system (PA 20). The objective of the invention here is to reduce the quantity of undissolved activator collecting in the sump of the machine by effecting rapid release of the available peracid. In such a simulated test, the products of the process show an increase in activity of more than 1.3 times compared to the compositions free of the granulation aid (the "standard composition") after 2 minutes of the test and an increase of more than 1.3 after 5 minutes of the test. The increases in performance may be up to 5 times that of the standard composition.

The 2 and 5 minutes activities at 20° C. (PA20, t=2 and t=5) are measured by the following test. The granulated composition (3 g) is added to 1 liter of distilled water containing 100 ppm of calcium ions and 40 g of a spray dried detergent base (ECE detergent base obtained from the Society of Dyers and Colourisis, Bradford, W. Yorks), thermostatically controlled at 20° C. Sodium perborate tetrahydrate (12 g) is added and the timer set to zero. Aliquots of 50 ml are taken at 2, 5 min and titrated as described above. The results are expressed as moles of peracid liberated per g of activator as a percentage of the theoretical quantity available.

Preferred products are those which the presence of the disintegration aid in the process also causes substantial increase in the activity of the composition when dissolved in water at 40° C. containing perborate (PA40). Particularly preferred are those products having a 30 minute activity which is more than double, preferably more than four times and most preferably more than ten times, for instance twenty five to fifty times, the activity of the corresponding compositions free of granulation aid. Other preferred compositions are those which have a 5 minute activity more than 1.2 times and preferably more than 1.5 times, for instance 1.7 to 2.5 times the 5 minute activity of the corresponding granules free of disintegration aid.

The 5 and 30 minute activities at 40° C. (PA40 t=5 and t=30) are a measure of activity throughout the wash cycle and are measured by the following test. The granulated composition (1 g) is added to 1 liter of distilled water containing 100 ppm of calcium ions and 1 drop of sodium dodecylbenzene sulphonate as a wetting agent, thermostatically controlled at 40° C. Sodium perborate tetrahydrate (5 g) is added and the timer set to zero. Aliquots (50 ml) were removed at 5 and 30 minutes and titrated at O° C. against 0.1M sodium thiosulphate in the presence of potassium iodide and glacial acetic acid. The end-point of the titration is determined using Vitex (trade mark) indicator. Duplicate titrations are carried out for each time interval.

The quantity of peracid found by each titration (PA40) is expressed as the number of moles of peracid/g activator, as 100% active material, i.e., a correction is made for the binder content.

The granule disintegration aid is a water soluble material that promotes rupture of the granules and exposure of the activator particles to the water. Furthermore the sequestrant of the granule disintegration aid has stabilising properties upon the peracid species formed on the reaction of the bleach and the activator. By using these stabilising compounds it is possible to maintain the peracid activity of the product granules over an extended period in the wash as compared to compositions free of the compounds. Thus the 30 minute activity at 40° C. (as defined above) can be maintained at, or close to, the 5 minute activity at 40° C.

The sequestering agent may be a water soluble salt of an amino carboxylic acid sequestering agent, for instance of nitrilo triacetic acid or of ethylene diamine tetra acetic acid or diethylene triamine penta acetic acid (or salts thereof) or of a low molecular weight anionic polymer formed from ethylenically unsaturated monomers e.g. unsaturated carboxylic acid or sulphonic acid monomers, such as acrylic acid, but preferably the sequesterant is a water soluble salt of a phosphonic acid, preferably an alkylene polyamine poly(methylene phosphonic acid) sequestrant.

The disintegration aid may comprise, in addition to such sequestering agents, water-soluble inorganic salts, such as alkali metal or alkaline earth metal salts, preferably sodium, potassium, calcium or magnesium salts or mixtures. The salts may be the water-soluble sulphates, carbonates or halides, usually chlorides, and mixtures can be used. Particularly suitable examples are sodium sulphate and magnesium sulphate.

The following are examples of phosphonic acid sequestrants which may be used: salts of ethylene diamine tetra (methylene phosphonic acid) (EDTMP) for instance as the free acid or as the hexa sodium salt, salts of diethylene triamine penta (methylene phosphonic acid) (DTPMP), salts of hexamethylene diamine tetraphosphonic acid (HMDTP), nitrilotrismethylenephosphonic acid (NTMP) or salts of hydroxyethyl-1,1-diphosphonic acid (HEDP). The phosphonic acids may be present in the granules as acceptable water-soluble and active salts e.g. with ammonia, alkali metal (generally sodium) or alkaline earth metal (generally calcium or magnesium) or as complexes with, for instance, zinc or aluminium.

The binder must be an organic polymeric binder that can be a natural or synthetic polymer and can be water swellable or water soluble. Synthetic binders include polyacrylates, polymaleates and polyvinyl pyrollidones, which may be cross linked, e.g., the cross linked polyvinyl pyrollidone sold under the trade mark Gafdis. Preferably the binder is a natural binder (including derivatives thereof), most preferably a starch binder, generally a starch ether, or a cellulose binder, generally a cellulose ether or ester. A particularly preferred binder is carboxymethyl cellulose CMC.

The amount of activator in the 100 parts by weight particulate mixture in the process is preferably in the range 98 to 50 parts by weight. The total amount of binder used in the process as a whole is in the range 2 to 70 parts by weight. It is a particular advantage of the invention that it is not necessary to keep the amount of binder below 6 parts by weight. Although the amount of binder can be below 6 parts in one preferred embodiment of the invention at least 10 parts by weight binder, for instance at least 11 parts by weight, most preferably at least 20 parts by weight binder, is used.

The amount of granule disintegration aid(s) will depend on the granule disintegration aid(s) being used and on the binder and the amount of binder but is in the range 1 to 20 parts by weight, preferably 2 to 15 parts and most preferably 3 to 10 parts by weight. Where an inorganic component is employed, the cation should contribute from 0.165% by weight of the product granule, preferably 0.3 to 2.0%, most preferably 0.4 to 1.5%.

Although the granules preferably consist substantially only of the activator, binder and disintegration aid(s) other components of the final detergent may be included in the process if desired in any suitable amounts. However such additions are used in an amount of less than 10 parts and generally less than 5 parts by weight.

One component that can usefully be included in the process is optical brightening agent since its incorporation in the granules avoids the problems associated with incorporating it in the remainder of the detergent composition. For instance it may be damaged by the spray drying to which the remainder of the composition is generally subjected. Another component that can conveniently be included in the process is an antisudsing (anti foaming) or foam stabilising agent. Other components that may be included in the process are other components of detergent compositions such as surfactants, anti-redeposition acids, builders, pigments or dyes and enzymes.

The particulate bleach activator is preferably tetra acetyl ethylene diamine but may be any of the known detergent bleach activators, such as those described in GB-A- 2,048,930 or EP-A-0037026. Other preferred activators include polyacetyl mono-, di-, or polysaccharides such as penta acetyl glucose, sulphonates such as isononanoyl oxybenzene sulphonate, nonyl benzoates, glycourils such as tetra acetyl glycouril, N-acyl amides, acylated diketopiperazines, and other N-acyl amines.

The activator should be presented for use in the particulate mix in the form of small particles generally having an average particle size in the range 50 to 500 μm, preferably 100 to 300 μm. Preferably substantially none of the particles has a size above 300 μm or, at the most, 500 μm.

The particulate binder used in the particulate mix preferably has an average particle size below 200 μm, generally below 100 μm, and is preferably free of particles above 200 μm in size.

The dry product granules preferably have an average particle size of between 300 and 1500 μm, most preferably 500 to 1000 μm. Preferably substantially none of them have a size above 2000 μm and preferably not above 1700 μm. Preferably none of the granules have a size below 50 μm and most preferably none have a size below about 125 μm. Product granules that are too fine or too coarse are preferably separated from the remainder of the granules and recycled to the beginning of the process for further granulation, often after crushing. A particular advantage of the invention is that the large amounts of binder that can be used minimise the risk of formation of fines.

In the process it is preferred that the aqueous solution used to moisten the particulate blend is substantially free of organic binder, in order to avoid the problems with handling viscous solutions or dispersions, mentioned above. Thus substantially all the organic binder is provided as dry particles to be mixed with the particulate activator.

By providing the disintegration aid in solution in the granulating liquid the present inventors have found that the disintegration aid is fully distributed throughout the granules so that it has optimal effects on the disintegration of the product granules upon their addition to water and on the stability of the bleach species formed.

We have found that by using this process the activities, especially at low temperatures, e.g. the 2 minute activity at 20° C. and the 5 and 30 minute activities at 40° C. as defined above, are greatly improved compared to a standard composition with organic binder without any disintegration aid, or with a water-swellable disintegration aid of the type discussed in e.g., EP-A0075818 and EP-A-0037026 or by incorporating particulate water-soluble components into the dry mixture, e.g. as described in DE-A-3247893 and DE-A-2048331.

The dry product granules can be incorporated in conventional detergent compositions that contain a suitable bleach component that is activated by the activator. The preferred bleaches are peroxygen sources especially inorganic persalts, especially perborates such as sodium perborate monohydrate or sodium percarbonate. Organic percompounds may also be used, especially organic peroxides, such as benzoyl peroxide.

The detergent containing the product the product granules formed by the process may contain, in addition to surfactants, detergent builders and anti-redeposition aids, enzymes, anti-sudsing agents, foam stabilisers, optical brightening agents, pigments, dyes and perfumes, further sequestrants, halide salts such as sodium bromide, manganese salts such as manganous sulphate and inert fillers such as sodium sulphate or silicate.

A particular advantage of the invention is that it is not necessary to include phosphates in the granulating process so that the detergent composition may be phosphate free although the phosphate may be included if desired.

The amount of activator, based on the total weight of the detergent, may be conventional or may be less than usual, because of the increased activity. Typical amounts are 1 to 5% based on the total detergent, or 1O to 50% based on the bleach.

The following examples are batchwise preparations suitable for the laboratory and larger scale production by employing techniques familiar to those skilled in the art. Granulation can also be effected on a large scale by the simultaneous addition of the individual components, in the same radios as those given in the following examples, into a high speed continuous agglomerator e.g. a Schugi Flexomix.

Reference Example

The standard composition is made by the following process:

Into a suitable mixing machine is weighed:

| | |
|---|---|
| TAED | 1012 g |
| CMC | 56 g |

The dry components are mixed for 3 minutes after which

| | |
|---|---|
| Water | 233 g |

is added, whilst mixing is continued, over 2 minutes. The product is then discharged and dried for 15 minutes at 60° C. using a fluid bed drier.

Examples 1–11 and Comparative examples A & B

Using the same general technique as in the reference example, particulate bleach activator and particulate binder are mixed dry in various proportions and are then sprayed with an aqueous solution of the granule disintegration aid or comparative water soluble compound (i.e. any inorganic salt alone or urea). The nature of the disintegration aid (i.e. sequestrant and inorganic salt, if any) and relative amounts of the components in the granules produced are shown in accompanying tables 1 and 2.

Dry product granules made by these general techniques were sieved to separate a fraction of 1000 to 1700 μm and the granules were then Tested for activity by the method described above.

The values of PA40 (t=5) and PA40 (t=30) and the value of PA20 (t=2) and PA20 (t=5) for the granules made in the examples are measured by the techniques described above. The values obtained are related to the standard composition for which PA40 (t=5), PA40 (t=30), PA20 (t=2) and PA20 (t=5) all are given the value 1.0. The results are shown in Tables 1 and 2, in which the following abbreviations are used:

TAED=tetra acetylethylene diamine
Na=sodium ions
Mg=magnesium ions
$SO_4$=sulphate anion
$CO_3$=carbonate anion
Cl=chloride anion
EDTMP=ethylenediaminetetra (methylene phosphonic acid) sodium salt
NTMP=nitrilotris (methylenephosphonic acid) sodium salt
DTPMP=diethylenetriaminepenta (methylene phosphonic acid) sodium salt
CMC=sodium salt of carboxymethylcellulose.
DTPA=diethylenetriamine pentaacetic acid sodium salt

TABLE 1

| | Weight percent component in dry granule (parts by weight in 100 parts dry particulate mixture) | | | | | | |
|---|---|---|---|---|---|---|---|
| | Examples | | | | | | |
| | INVENTION | | | | COMPARATIVE | | |
| | 1 | 2 | 3 | 4 | A | B | Standard |
| TAED | 60 (75) | 60 (73) | 90 (96) | 60 (72) | 60 (73) | 60 (72) | (95) |
| $NaSO_4$, $10H_2O$ | — | — | — | — | — | 5 | |
| $NaSO_4$, $7H_2O$ | 7 | 7 | — | — | — | — | |
| EDTMP | 6 | 1 | 3.8 | — | — | — | |
| DTPA | — | — | — | 5 | — | — | |
| Urea | — | — | — | — | 5 | — | |
| CMC | 20 (25) | 22 (27) | 4 (4) | 23 (28) | 22 (27) | 23 (26) | (5) |
| Water | | | | to 100% | | | |
| PA40 t = 5 | 20 | 1.8 | 1.7 | 1.5 | 1.2 | 0.9 | 1.0 |
| t = 30 | 35 | 35 | 34 | 9 | 4 | 2.5 | 1.0 |
| PA20 t = 2 | 2.6 | 2.0 | 1.4 | 1.5 | 0.7 | 0.6 | 1.0 |
| t = 5 | 2.1 | 1.6 | 1.3 | 1.3 | 0.9 | 0.8 | 1.0 |

TABLE 2

| | Weight percent component in dry granule (parts by weight in 100 parts dry particulate mixture) | | | | | | |
|---|---|---|---|---|---|---|---|
| | Examples | | | | | | |
| | 5 | 6 | 7 | 8 | 9 | 10 | 11 |
| TAED | 82 (95) | 86 (96) | 85 (96) | 85 (96) | 85 (96) | 60 (75) | 88 (94) |
| Na | 0.8 | 0.8 | 1.0 | 1.0 | 1.0 | — | — |
| Mg | — | — | — | — | — | 0.7 | 0.7 |
| $SO_4$ | 1.7 | 1.7 | 2.1 | — | — | 2.8 | 2.8 |
| Cl | — | — | — | — | 1.5 | — | — |
| $CO_3$ | — | — | — | 1.3 | — | — | — |
| EDTMP* | — | — | 4.8 | 4.8 | 4.8 | 7.0 | 1.2 |
| NTMP* | 4.0 | — | — | — | — | — | — |
| DTPMP* | — | 4.8 | — | — | — | — | — |
| CMC | 4.5 (5) | 4.0 (4) | 4.0 (4) | 4.0 (4) | 4.0 (4) | 20 (25) | 6.0 (6) |
| Water | | | | to 100% | | | |
| PA20 t = 2 | 1.8 | 1.7 | 1.5 | 1.4 | 1.4 | 2.6 | 2.0 |
| t = 5 | 1.3 | 1.5 | 1.5 | 1.4 | 1.5 | 2.1 | 1.6 |

*In table 2, the weights of the phosphonic acids excluding the contribution of the sodium counterion is reported.

From these examples it will be apparent that an activator granule formed using a granulating liquid including dissolved sequestrant and any optional water-soluble in organic salt offers a significant improvement in both the immediate availability of peracid from the coated activator and the level throughout the wash part of the cycle, as compared to the standard composition and to compositions containing urea instead of a disintegration aid as defined in the present invention or an inorganic salt alone (comparative examples A and B). The combination of phosphonic acid with inorganic salt gives an even further improvement (over the use of sequestrant alone) in the immediate availability of peracid at 20° C. i.e. under cold-fill conditions.

Comparative Example C

A granulated mixture was made by using components in the same proportions as for example 10 but by mixing all the ingredients dry (the EDTMP was in the form of the free acid) and then adding pure water to the blend during mixing (instead of using a solution of EDTMP sodium salt and magnesium sulphate). The activities at 20° C. (PA20) were t=2, 0.68 and t=5, 1.06. This shows that the granules made with solid phosphonic acid and inorganic salt rather than a solution of sequestrant have much lower activities under cold fill conditions. This is believed by the inventors to be due at least in part to improved distribution of disintegration aid in the product granules.

Comparative examples D to G

Granules of activator were formed using a range of conventional tablet disintegration aids, i.e. which are water-swellable, instead of the water-soluble disintegration aids used in the present invention. A process similar to that used in the reference example to make the standard composition was used but replacing part of the binder with the swellable disintegrating aid. The type and amount (parts by weight based on 100 parts dry ingredients containing 95 parts TAED and the balance to 100 parts of CMC) of disintegrating aid and PA20 values are given in the table below:

TABLE 3

| | Comparative examples | | | | |
|---|---|---|---|---|---|
| | D | E | F | G | Standard |
| Avicell (microcrystalline cellulose) | 0.5 | 2.0 | — | — | — |
| Ac-di-sol (modified cellulose gum) | — | — | 0.5 | 2.0 | — |
| PA20 t = 2 | 0.53 | 0.62 | 0.86 | 0.95 | 1.0 |
| t = 5 | 0.78 | 0.78 | 0.90 | 0.95 | 1.0 |

Table 3 shows that conventional disintegration agents of the water-swellable type produce granules which have even worse PA20 values than the standard composition.

Wash Tests

The importance of the improved availability of peracid which can be obtained as a result of the invention is demonstrated by the results of carefully controlled wash tests presented in Table 4 below:

Wash tests were carried out at 40° C. and 50° C. (HLCC programmes 5 and 4 respectively) on red wine stains using ECE detergent base and 12% sodium perborate tetrahydrate. Hoover Computer Control 1100 machines were used with a controlled water hardness of 250 ppm calcium carbonate. Activator granule additions were adjusted to give 3% TAED by weight in the detergent mixture. Stain removal was measured by reflectance using a tristimulus colour analysing computer and the results are shown in Table 4.

The value of ΔR% in the table is the percentage difference in stain removal as measured by reflectance from a washed swatch of stained cloth, with the value of ΔR% for the standard composition being given the value 0.

TABLE 4

| EXAMPLE | ΔR % 40° C. | ΔR % 50° C. |
|---|---|---|
| 5 | +10 | +17 |
| 6 | +14 | +17 |
| 7 | +7 | +18 |
| 8 | +5 | +12 |
| 9 | +5 | +15 |
| 10 | +15 | +17 |
| 11 | +7 | +7 |
| Standard | 0 | 0 |

These results demonstrate the value of the invention in a practical wash test.

Comparative Examples J to P and Example 12

Example 1 of Kruse U.S. Pat. No. 4,726,908 was repeated using conditions as close as possible to those described. However instead of using a Loedige mixer, a Schugi Flexomix-type mixer was used. Such a mixer is of the general type described in the paragraph bridging columns 2 and 3 of U.S. Pat. No. 4,726,908. The process was compared with similar processes using different ingredients, ie as indicated under comparative examples J-N below:

Comparative Example J (Following Example 1 of U.S. Pat. No. 4,726,908 with the weights of the ingredients scaled down) 25.3 g precipitated silica, 50.2 g TAED, 18.4 g cetrimide (tetradecyltrimethyl ammonium bromide) and 6 g of a mixture of 40% by weight silicone and 60% by weight silica were mixed dry at room temperature and then sprayed with a liquid mixture of 50.2 g $C_{14-15}$ oxoalcohol plus 7 moles ethylene oxide with 17.3 g a 25% aqueous solution of ethylene diamine tetra (methylene phosphonic acid) sodium salt (EDTMP). The mixing process produced a granulate which was transferred to a fluid bed drier, where it was dried and then cooled to provide the final granulate. The amount of EDTMP added is in proportion to the example of U.S. Pat. No. 4,726,908 and the extra water used as a result in the process will make no difference to the final product.

Comparative Example K

The process of Comparative Example J was repeated using the phosphonate solution only as the granulating liquid, i.e. omitting the liquid surfactant.

Comparative Example L 300 g TAED was sprayed in the mixer with 31.2 g of a 24% aqueous solution of EDTMP sodium salt plus 22.4 g water containing 6.4 g water containing 6.4 g (anhydrous) sodium sulphate in solution. The granulate was dried in a fluid bed drier.

Comparative Example M

The process described in Comparative Example L was repeated with the addition of 150 g of the surfactant used in Comparative Example J as a granulating adjuvant. 150 g was used since that is the same proportion compared to dry solids weight as in Comparative Example J.

Comparative Example N

The process of comparative example M was repeated but using the liquid surfactant in an amount of 20 g, this level being about the same level by weight as CMC binder generally used in the process of the invention.

Example 12

(according to the invention)

279 g TAED, 21 g CMC were dry mixed and then sprayed with a liquid mixture of 31.2 g 24% aqueous solution of EDTMP sodium salt. In 22.4 g (water with dissolved 6.4 g anhydrous sodium sulphate). The granulate was dried as in Comparative Example J.

Comparative Example P

The process of Example 12 was repeated but with the addition of 150 g of the surfactant used in Comparative Example J as part of the granulating liquid.

Results

The processes of comparative examples J to P and example 12 were observed throughout the process. The following observations were made:

Comparative Example J

The process produced granules but these had a slightly sticky surface and tended to stick together.

Comparative Example K

The particles did not granulate at all, addition of the phosphonate solution having practically no effect on the mix of dry particles.

Comparative Example L

The process did form a granulate.

Comparative Examples M and N

Neither processes formed a granulate. In the example M a sticky paste was formed which failed to granulate. In Example N the process was similar to that described for Comparative Example K above, in that the liquid had practically no effect on the particulate mix.

Example 12

(invention)

The process formed dry free flowing easy to handle granules.

Comparative Example P

As in the first process carried out in Comparative Example M the addition of the granulating liquid formed a soggy pasty mix which failed to granulate.

The products of processes Comparative Examples J and L and example 12 which yielded a testable granulate were subjected to tests to measure the 2 and 5 minute activity at 20° C. These tests were carried out as described above. The results are shown in the following table.

TABLE 5

| Example | PA 20° C. t = 2 | PA 20° C. t = 5 |
|---|---|---|
| Comparative J | 0.9 | 1.2 |
| Comparative L | 1.5 | 1.5 |
| Invention 12 | 1.5 | 1.5 |

The results shown in Table 5 illustrate that the granulate produced according to Example 1 of U.S. Pat. No. 4,726,908 had unsatisfactory 2 and 5 minute activities at 20° C. and would therefore be unsatisfactory for use in cold-fill washing machines. The products of Comparative Example L and Example 12 produced granules which had satisfactory activities.

Physical Properties

The granulates produced in Comparative Example L and Example 12 were subjected to a test of their physical characteristics to evaulate their storage stability. The attrition test carried out simulates the effects of handling the granules, during production of a powdered detergent and its transport. It was carried out by selecting a fraction of granules having sizes between 425 μm and 850 μm and placing 30 g of the fraction onto a 425 μm screen with 8 stainless steel balls each having a diameter of 2 cm and a weight of 32.5 g. The sieve was shaken for 5 minutes on a mechanical shaker and the weight of particles remaining on the screen measured. The results showed that for the granule produced according to Comparative Example L, 1.8 g remained on the screen. For the granule produced by Example 12, 7.3 g remained on the screen. The results for Comparative Example L show that almost all of the granulate had disintegrated and passed through the screen. Such a granule would be unsatisfactory for use in a granular detergent, as the powder would sink to the bottom of any container and may create dusting problems during manufacture of such compositions. The product of Example 12, on the other hand, stood up to the attrition test relatively well and is satisfactory for use in such detergent compositions.

We claim:

1. A process wherein 100 parts by weight of a particulate mixture consisting of:

i) 98 to 38 parts by weight of bleach activator particles, ii) 2 to 70 parts by weight of water-soluble or water-swellable organic binder selected from the group consisting of starch and its derivatives, cellulose and its derivatives, polyacrylates, polymaleates and polyvinyl pyrrolidones, and iii) up to 10 parts by weight other particulate components, is dry mixed and moistened during mixing by an aqueous granulating liquid which consists of:

(a) 1 to 20 parts by weight of dissolved granule disintegration aid, which is a sequestrant selected from the group consisting of ethylenediaminetetra (methylene phosphonic acid), diethylenetriaminepenta (methylene phosphonic acid) and soluble salts thereof, or a mixture of said sequestrant with a water soluble inorganic salt selected from the group consisting of sodium, potassium, calcium and magnesium sulfate, carbonate and chloride, and mixtures thereof, (b) 0 to 70 parts by weight water soluble or water swellable organic binder selected from the group consisting of starch and its derivatives, cellulose and its derivatives, polyacrylates, polymaleates and polyvinyl pyrrolidone provided that the total amount of organic binder used in the process is no more than 70 parts by weight, (c) up to 10 parts by weight other water-dispersible components, provided that the total amount of said other particulate component and said other water-dispersible component is no more than 10 parts by weight, and (d) water to form moist granules and the moist granules are then dried to form any product granules, wherein the granule disintegration aid constitutes at least 2% by weight of the total granule weight, the cation of the water soluble inorganic salt contributes up to 1.5% by weight of the total granule weight, and said organic binder contributes at least about 10% by weight of the total granule weight, the 30 minute activity of the granules when dissolved in water and at 40° containing perborate being more than 2 times and up to about 50 times the activity of a standard composition which is formed by a process in which 56 g carboxymethyl cellulose and 1012 g tetraacetylethylene diamine are dry mixed and moistened during mixing with water to form moist granules and the moist granules are then dried.

2. A process according to claim 1 in which the sequestrant is a soluble salt of ethylenediaminetetra (methylene phosphonic acid) or diethylenetriaminepenta (methylene phosphonic acid).

3. A process according to claim 1 in which the granule disintegration and is a mixture of said sequestrant and said water soluble inorganic salt.

4. A process according to claim 1 in which the activator is tetra acetyl ethylene diamine.

5. A process according to claim 1 in which the activator is initially provided in the form of particles having sizes in the range from about 100 to about 300 μm and the dried product granules have an average particle size in the range of about 300 to about 1500 μm with substantially none of the granules having a size above about 1700 μm.

6. A process according to claim 1 in which the granulating liquid is substantially free of organic binder material.

7. A process according to claim 1 in which the binder is a carboxymethyl cellulose.

8. A process according to claim 1 in which the 5 minute activity of the dry product granules when dissolved in water at 40° C. containing perborate is more than 1.2 times and up to about 5 times the activity of a standard composition which is formed by a process in which 56 g carboxymethyl cellulose and 1012 g tetracetyl ethylene diamine are dry mixed and moistened during mixing with water to form moist granules and the moist granules are then dried.

9. A process according to claim 1 in which the 2 minute activity of the dry product granules when dissolved in water at 20° C. is in the range of about 1.5 to about 3.0 times the activity of a standard composition which is formed by a process in which 56 g carboxymethyl cellulose and 1012 g tetraacetylethylene diamine are dry mixed and moistened during mixing with water to form moist granules and the moist granules are then dried.

10. A process according to claim 1 in which the said particulate mixture consists of more than 20 parts by weight of binder and in which the granulating liquid contains 1 to 15 parts by weight of granule disintegration aid.

11. A process according to claim 10 in which the sequestrant is a soluble salt of ethylenediaminetetra (methylene phosphonic acid) or diethylenetriaminepenta (methylene phosphonic acid).

12. A granulated bleach activator composition produced by the process of claim 1.

13. A granular laundry detergent composition comprising the bleach activator composition of claim 12, a peroxygen bleach component, surfactant and builder.

14. A process according to claim 1 in which the total amount of binder in the dry particulate mixture and in the granulating liquid is at least 20 parts by weight.

15. A process according to claim 1 in which the activator is tetracetyl ethylene diamine.

16. A process according to claim 15 in which the binder is carboxymethyl cellulose.

17. A granulated bleach activator composition produced by the process of claim 16.

18. A granular laundry detergent composition comprising the bleach activator composition of claim 17, a peroxygen bleach component, surfactant and builder.

19. A process according to claim 15 in which the activator is initially provided in the form of particles having sizes in the range from about 100 to about 300 μm and the granules have an average particle size in the range of about 300 to about 1500 μm with substantially none of the granules having a size above about 1700 μm.

20. A process according to claim 19 in which the sequestrant is a soluble salt of ethylinediametetra (methylene phosphonic acid) or diethylenetriaminepenta (methylene phosphonic acid).

21. A process according to claim 20 in which the binder is carboxymethyl cellulose.

22. A granulated bleach activator composition produced by the process of claim 21.

23. A granular laundry detergent composition comprising the bleach activator composition of claim 22, a peroxygen bleach component, surfactant and builder.

* * * * *